US006149458A

United States Patent [19]

Daoud

[11] Patent Number: 6,149,458

[45] Date of Patent: Nov. 21, 2000

[54] NETWORK INTERFACE DEVICE TEST ACCESS WITH CROSS-CONNECT FEATURE

[75] Inventor: Bassel Hage Daoud, Parsippany, N.J.

[73] Assignee: Lucent Technologies, Inc., Murray Hill, N.J.

[21] Appl. No.: 09/107,409

[22] Filed: Jun. 30, 1998

[51] Int. Cl.[7] ..... H01R 31/08

[52] U.S. Cl. ..... 439/509; 439/676; 379/399

[58] Field of Search ..... 439/507, 509, 439/144, 660, 345, 676; 379/399, 438

[56] References Cited

U.S. PATENT DOCUMENTS

| | | | |
|---|---|---|---|
| 4,979,209 | 12/1990 | Collins et al. | 379/399 |
| 5,297,199 | 3/1994 | Graham et al. | 379/399 |
| 5,497,416 | 3/1996 | Butler, III et al. | 379/399 |
| 5,719,934 | 2/1998 | Tuvy | 379/399 |

*Primary Examiner*—Renne S. Luebke
*Assistant Examiner*—T. C. Patel
*Attorney, Agent, or Firm*—Birch, Stewart, Kolasch & Birch, LLP

[57] ABSTRACT

A network interface device is attachable to an intermediate field of a building entrance protector unit. The network interface device includes a jack section having a jack which is designed to receive the plug of a standard telephone. The jack includes wire leads which may be connected to any of the terminals on the intermediate field. The jack section is mountable into a base module which is in turn attachable to the intermediate field by wedging a portion of the base module between adjacent terminals on the intermediate field. A plug section is pivotally connected to the jack section by a living hinge. The plug section includes a plug having a pair of conductive blades therein. The network interface device performs a connecting function when the plug is pivoted to a position within the jack, and the conductive blades establish an electrical connection between the wire leads connected to the telephone company network and the wire leads connected to the customer equipment. When there is a need to disconnect the customer from the telephone company network or to test the system, the plug can simply be pivoted out of the jack, and a standard working telephone can be plugged into the jack for line testing purposes.

24 Claims, 10 Drawing Sheets

NETWORK INTERFACE DEVICE TEST ACCESS WITH CROSS-CONNECT FEATURE

BACKGROUND OF THE INVENTION

1. Field of the Invention

The present invention relates to a connector for providing an electrical connecting between a telephone network and a customer, and more particularly, to a network interface device attachable to an intermediate field of a building entrance protector which additionally provides a convenient disconnect function so that the customer can be disconnected from the telephone network, and a standard telephone may be plugged into the network interface device for line testing purposes.

2. Description of the Background Art

Network interface units constitute the separation between the telephone company network and a customer's equipment. In buildings having multiple subscribers, the network interface unit may comprise a building entrance protector, which is typically installed in the basement of the building.

One example of such a building entrance protector is shown in FIGS. 10 and 11. The building entrance protector 100 includes a box 102 having a lid 104 pivotally attached thereto to form an enclosure. A cable 106 from the telephone company central office is fed to the interior of the box 102. The cable 106 includes multiple pairs of wires which are connected to protector modules arranged on a protector field 108. The connection is typically made using a wire wrap 110 on the underside of the protector field 108. The protector modules provide protection against electrical surges for the customer.

From the protector modules, the wire pairs are connected to selected terminals 112*a* on the underside of an intermediate field 112, commonly known as a 66-type block. A cable 114 from the customers is also fed to the interior of the box 102. The cable 114 may typically include twenty-five wire pairs entering into the box 102 through an RJ21 connector 116. Wire pairs from the customers are connected to selected other terminals 112*b* on the underside of the intermediate field 112.

In order to interconnect the network side terminals 112*a* to the customer side terminals 112*b*, it is known to use bridging clips 118 which are placed over adjacent terminals 112*a*, 112*b* on the upper side of the intermediate field 112, as shown in FIG. 10. A pair of bridging clips 118 are used to connect the pair of terminals 112*a* on the network side to the pair of terminals 112*b* of the customer, in order to establish an electrical connection. In order to disconnect the customer side equipment from the network side equipment, it is necessary to remove the bridging clips 118 from the terminals 112*a*, 112*b*.

Another method of connecting the network side terminals 112*a* to the customer side terminals 112*b* is to use jumper wires 120, as shown in FIG. 12. However, unlike bridging clips 118 which are limited to use on adjacent terminals, jumper wires 120 may be used to interconnect non-adjacent pairs of terminals.

At times, a problem with the telephone service of the customer will develop. It is useful for the customer to be able to plug a working telephone into a test jack in order to determine whether the problem exists in the lines of the telephone company or the lines of the customer. However, the method of interconnection using bridging clips does not provide a mechanism for allowing the customer to plug a working telephone into the network for testing purposes.

Also, a tenant may relocate within the same building from one office or apartment to another, and the tenant would like to retain the same phone number. This creates a problem since the telephone network wires associated with that particular phone number do not change, and thus their position on the intermediate block does not change. However, the tenant is now in a new location, and the wires from that new location are connected to different terminals on the intermediate block which are not immediately adjacent to the network terminals as they may have been before. Therefore, bridging clips can no longer be used to connect the network terminals to the customer terminals, since the bridging clips have no ability to cross-connect non-adjacent terminals. Instead, it becomes necessary for the telephone technician to place jumper wires on the terminals of the intermediate block in order to connect the customer to the telephone network. However, this method of interconnection using jumper wires also does not provide a mechanism for allowing the customer to plug a working telephone into the network for testing purposes.

There is a need in the art for a network interface device which can quickly and easily connect the customer to the telephone network, even if the customer's intermediate field terminals are not exactly adjacent to the telephone network's intermediate field terminals, while also providing a disconnect feature whereby the customer can be disconnected from the telephone network, and a standard telephone may be plugged into the network interface device for line testing purposes.

SUMMARY OF THE INVENTION

The present invention fulfills the aforementioned need in the art by providing a network interface device which is connectable to the terminals of an intermediate field, and which provides both a connecting and a disconnecting function. The network interface device includes a jack section having a jack which is designed to receive the plug of a standard telephone. The jack section is mountable into a base module which is in turn attachable to the intermediate field by wedging a portion of the base module between adjacent terminals on the intermediate field. The jack includes two pairs of wires extending therefrom, with one pair being connected to the telephone company network terminals on the intermediate field, and the other pair being connected to the customer terminals on the intermediate field A plug section is pivotally connected to the jack by a living hinge. The plug section includes a plug having a pair of conductive blades therein. When the plug is pivoted to a position within the jack, the conductive blades establish an electrical connection between the telephone company network terminals and the customer terminals. When there is a need to test the system, the plug can simply be pivoted out of the jack, and a working telephone can be plugged into the jack for testing purposes.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
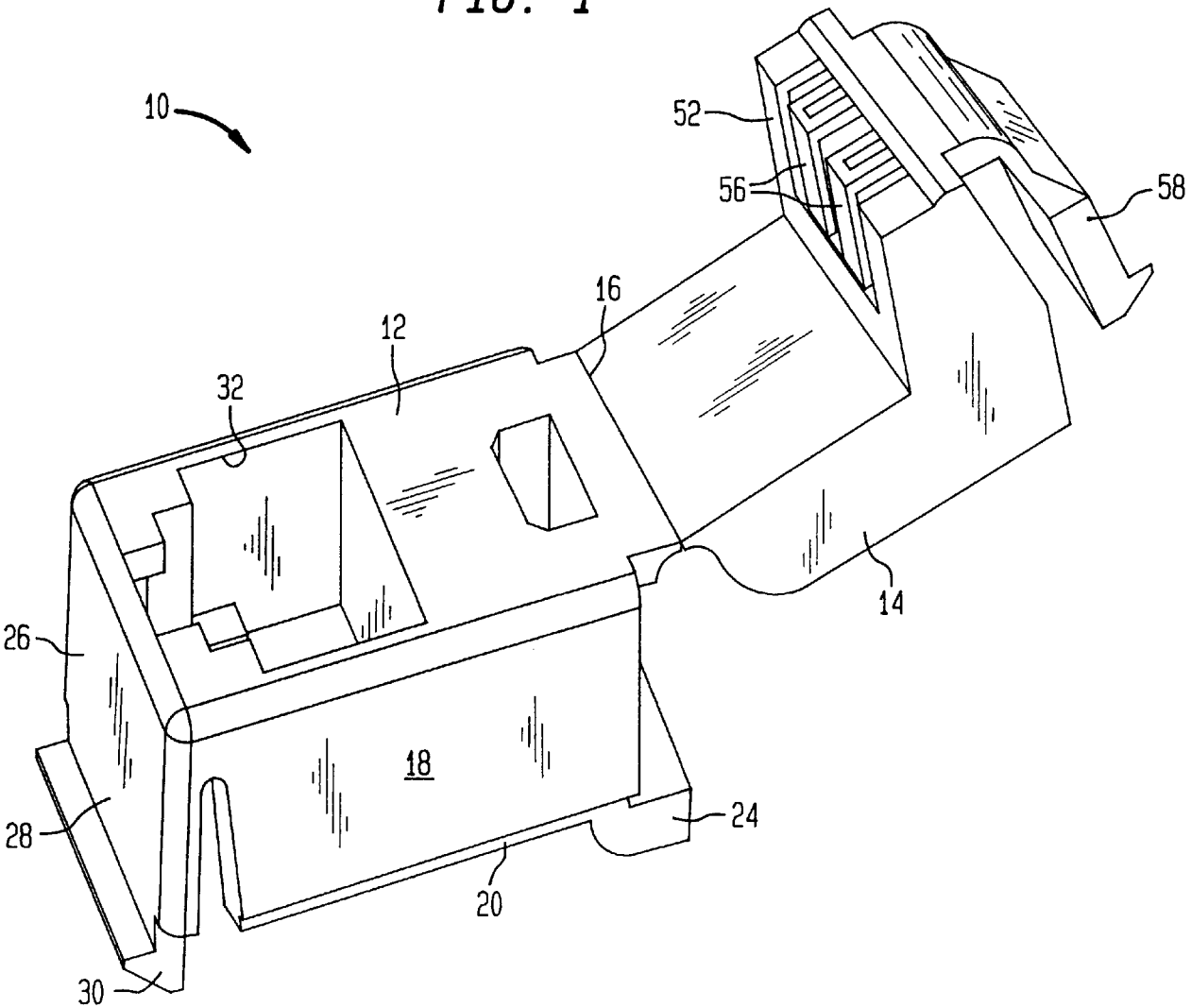
FIG. 1 is a perspective view of a network interface device according to the present invention in an open position.
Figure 2:
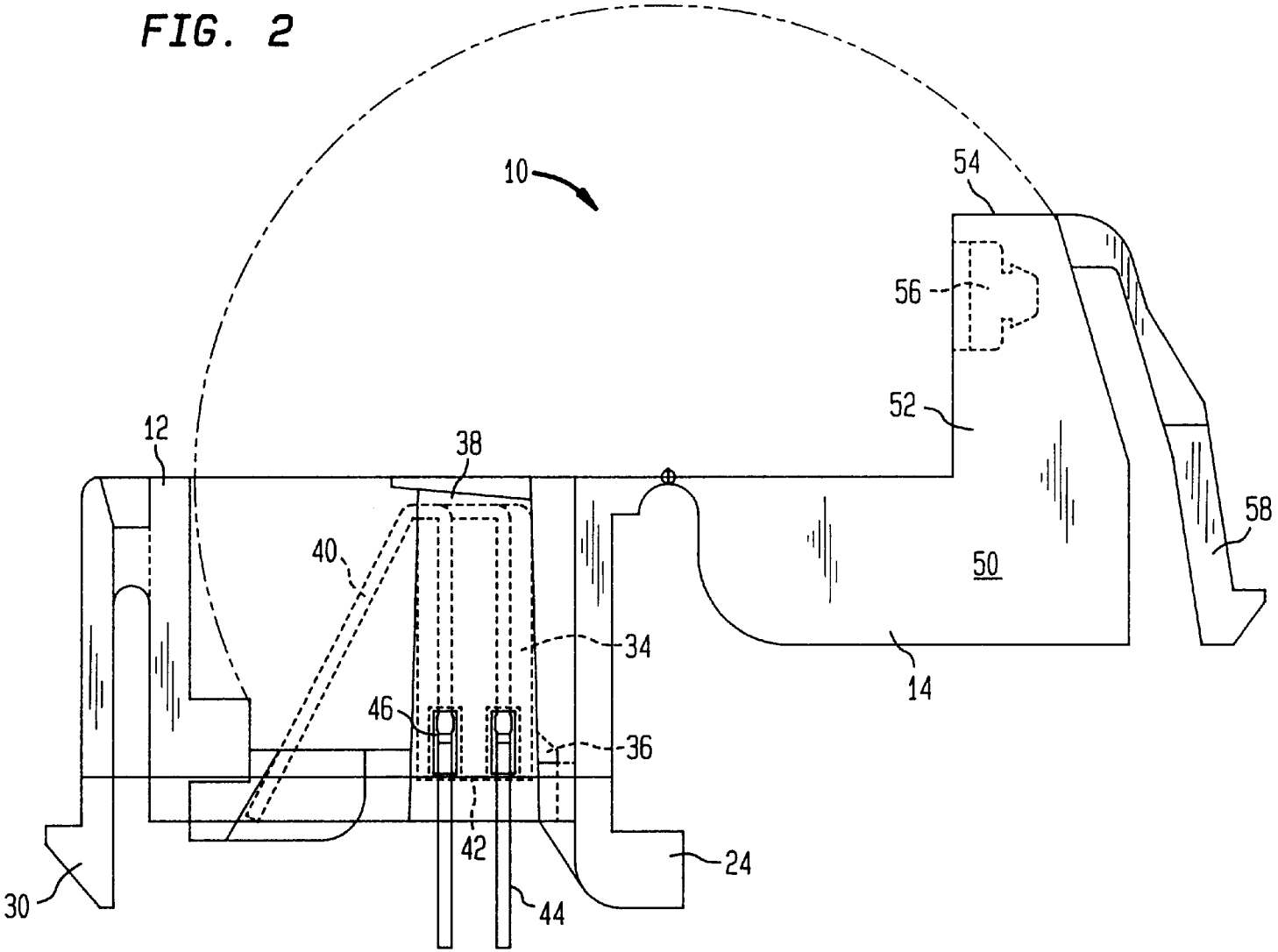
FIG. 2 is a side view of the network interface device in an open position.
Figure 3:
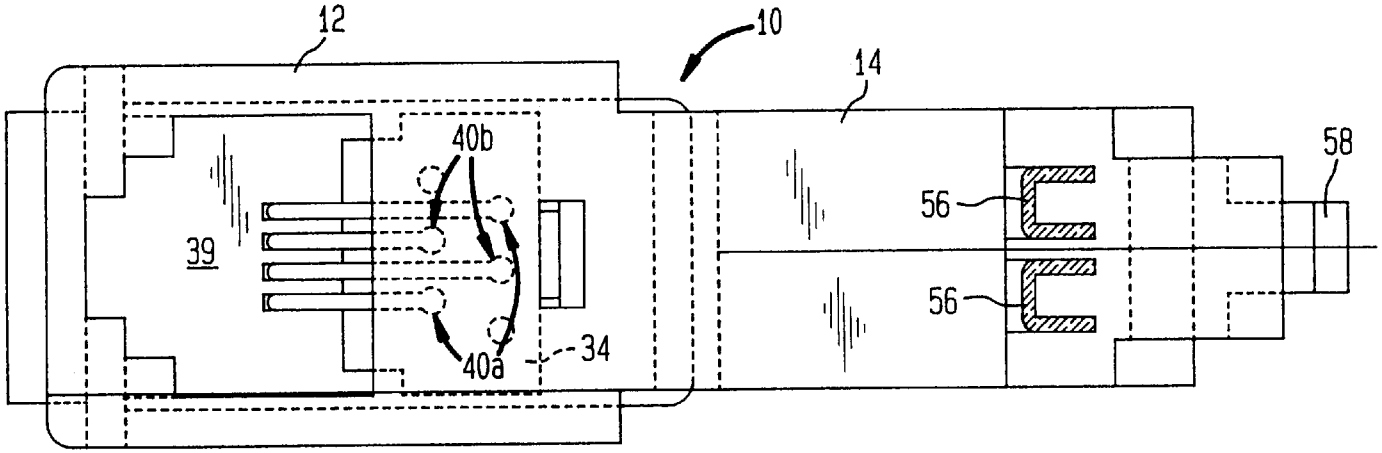
FIG. 3 is a top view of the network interface device in the open position of FIG. 2 showing the upper portion of the insert with spring wires therein.
Figure 4:
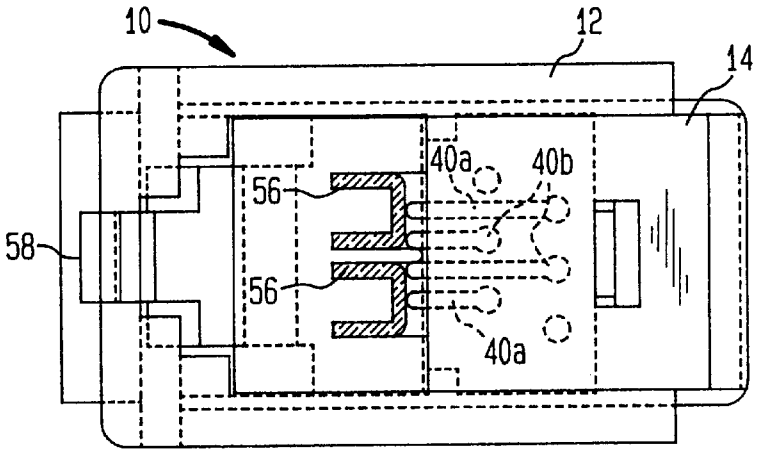
FIG. 4 is a top view of the network interface device in a closed position showing the conductive blades contacting the spring wires.
Figure 6:
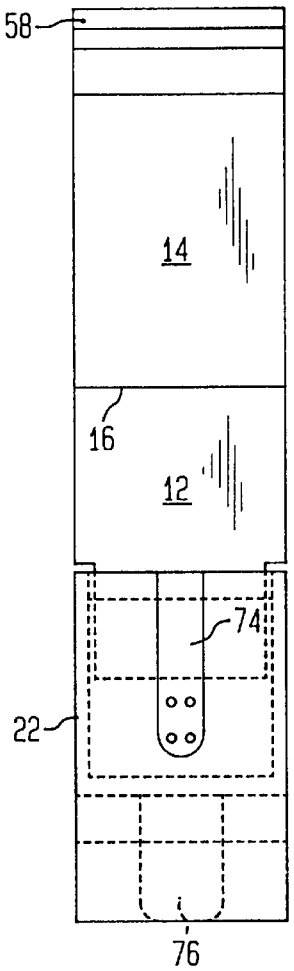
FIG. 6 is an end view of the network interface device and base of FIG. 5.
Figure 5:
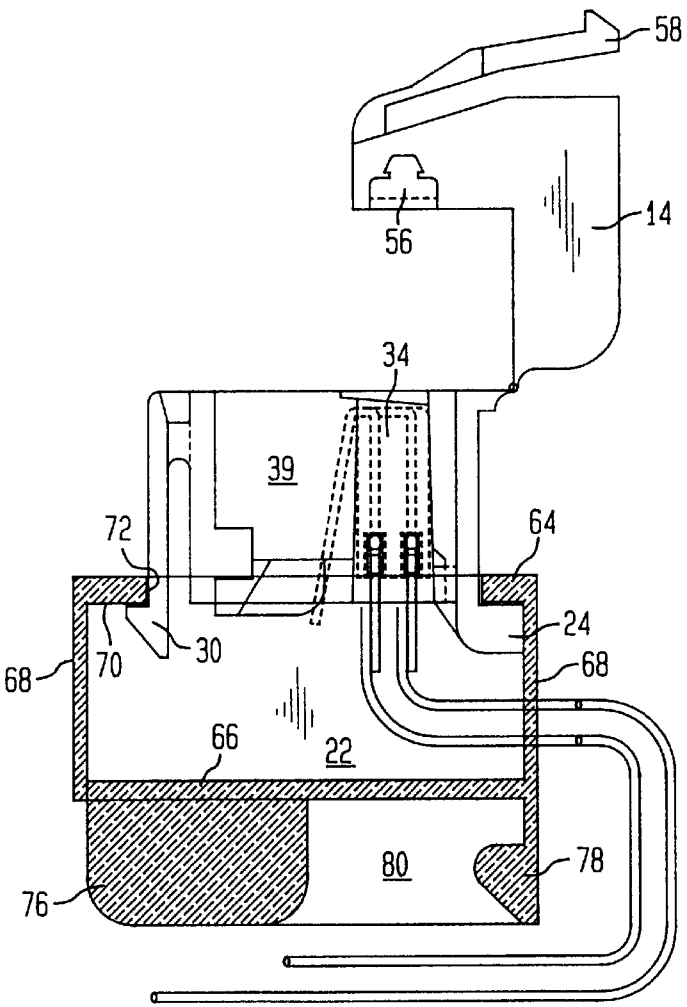
FIG. 5 is a side view of the network interface device in a partially open position and installed on a base.
Figure 7:
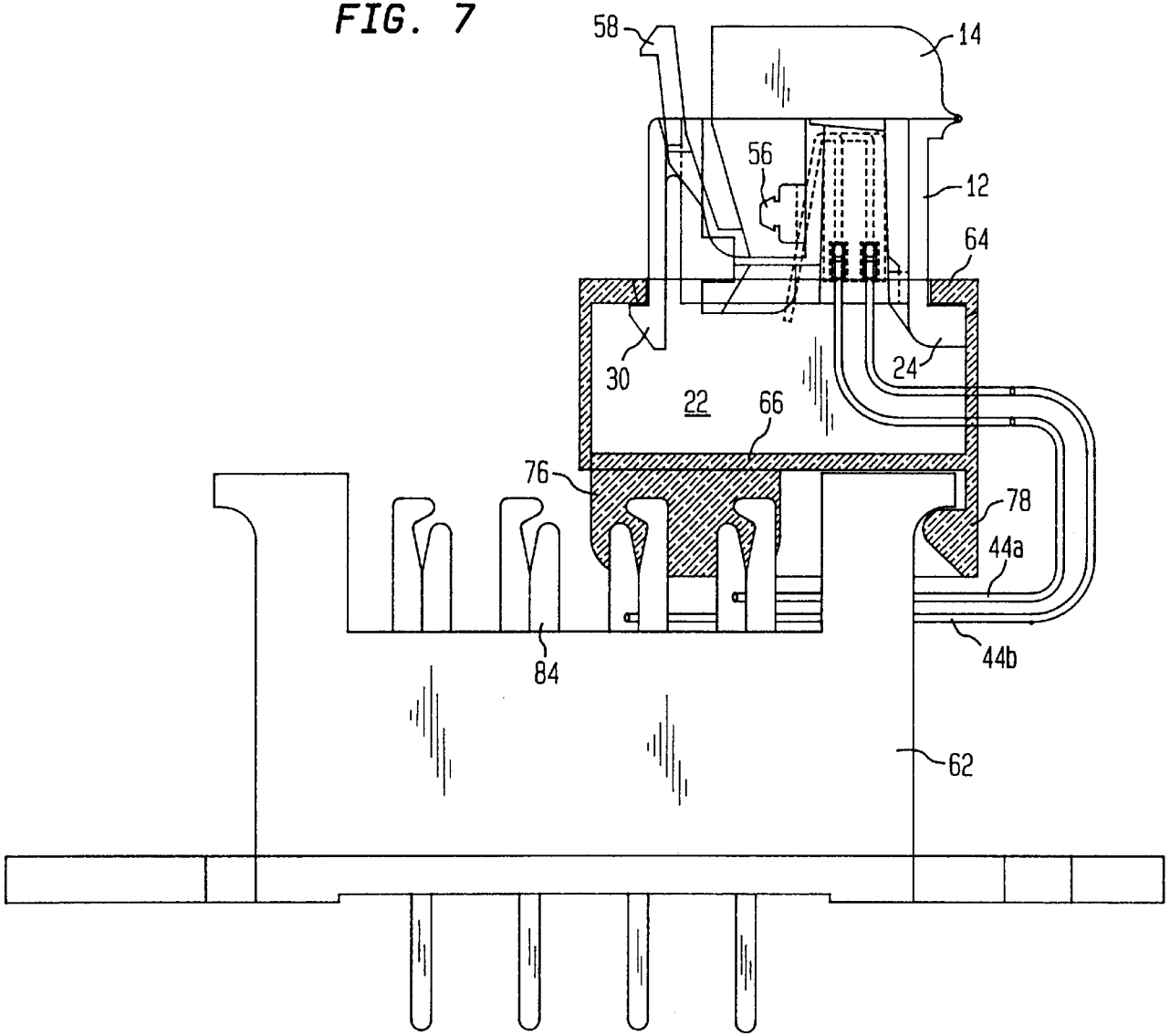
FIG. 7 is a side view showing the network interface device in the closed position installed onto the terminals of an intermediate field.

Referring in detail to the drawings, and with particular reference to FIG. 1, a network interface device 10 is shown. The network interface device 10 includes a jack section 12 and a plug section 14 pivotally connected to the jack section 12 by a living hinge 16. The jack section 12 and the plug section 14 are preferably formed as an integral one-piece unit from an insulative plastic material, such as polypropylene.

The jack section 12 has an essentially block-like main body portion 18. A lower portion of the main body portion 18 is formed as a rectangular base 20. The rectangular base 20 is receivable in a correspondingly shaped aperture in a base module 22 which will be described in detail later.

The rectangular base 20 includes a lip 24 extending laterally away from one side of the main body portion 18. A latch 26 is located on the side of the main body portion 18 opposite to the lip 24. The latch 26 includes a cantilevered arm 28 extending downwardly from the upper portion of the main body portion 18. The cantilevered arm 28 terminates in a hook 30 directed outwardly from the main body portion 18. The lip 24 and the latch 26 together form a mechanism for retaining the jack section 12 within the aperture of the base module 22.

The upper surface of the main body portion 18 includes an essentially rectangular aperture 32 therein which extends downwardly into the main body one side of the aperture 32, and is held there by a hook 36. The insert 34 is preferably formed of a polymer material, such as polycarbonate or polypropylene. The aperture 32 having the insert 34 at one side thereof forms a jack 39 similar to a conventional telephone wall jack.

An upper end 38 of the insert 34 contains four spring wires 40 extending therefrom. The spring wires 40 comprise an outermost pair 40*a* and an innermost pair 40*b*. The spring wires 40 form contact points for the plug section 14 which will be described in detail later.

A lower end 42 of the insert 34 includes four wire leads 44 extending therefrom. The wire leads 44 are attached to the spring wires 40 by suitable connectors 46, such as solderless crimped connectors. The wire leads 44 comprise a first pair 44*a* connected to the outermost pair 40*a* of spring wires 40, and a second pair 44*b* connected to the innermost pair 40*b* of spring wires 40.

The plug section 14 has a main body portion 50 having a plug 52 extending from a lower side 54 thereof. A pair of conductive blades 56 are located within the plug 52. The conductive blades 56 may be formed of phosphorbronze or other conductive material. The plug section 14 is pivotal about the living hinge 16 from an open position where the plug 52 is out of and spaced from the jack 39, to a closed position where the plug 52 is received within the jack 39. A latch 58 is provided on the plug section 14 for latching the plug section 14 to the jack section 12 in the closed position.

When the plug 52 is not located in the jack 39, no interconnections are made between the wire leads 44*a* and the wire leads 44*b*. Thus, the customer premises is disconnected from the central office of the telephone network side. At this time, a standard four pin RJ11 plug of a test telephone (not shown) may be plugged into the jack 39 for testing purposes. This arrangement allows simultaneous monitoring of the central office line and the customer line.

When the plug section 14 is pivoted to the closed position where the plug 52 is located within the jack 39, the conductive blades 56 located in the plug 52 make contact with respective pairs of the spring wires 40 in the jack 39. Specifically, one of the pair of conductive blades 56 is engagable with one of the pair of inner spring wires 40*b* and an adjacent one of the pair of outer spring wires 40*a*, and the other of the pair of conductive blades 56 is engagable with the other of the pair of inner spring wires 40*b* and an adjacent one of the pair of outer spring wires 40*a*. The conductive blades 56 therefore establish an electrical interconnection between the wire leads 44*a* and the wire leads 44*b*. In this orientation with the plug section 14 in the closed position, an electrical connection is established between the customer side and the telephone network side.

A base module 22 is provided for attaching the network interface device 10 to an intermediate field 62 of a building entrance protector, or BEP. The base module includes a top wall 64, a bottom wall 66, and a plurality of side walls 68. The top wall 64 includes an upper rim 70 which forms an aperture 72 through which the rectangular base 20 of the jack section 12 is inserted. The base module 22 is preferably formed of a polymer material, such as polycarbonate or polypropylene.

One of the side walls 68 includes a slot 74 through which the wire leads 44 may pass and exit the interior of the base module 22. The bottom wall 66 of the base module 22 includes a lug 76 extending downwardly therefrom near one side of the bottom wall 66, and a hook member 78 extending downwardly therefrom near the other side of the bottom wall 66. A web 80 extends centrally along the base module 22 and between the hook member 78 and the lug 76.

Mounting of the jack section 12 in the aperture 72 is accomplished by first inserting the rectangular base 20 into the aperture 72 so that the wire leads 44 pass through the slot 74 and the lip 24 is beneath an underside of the upper rim 70 of the base module 22. The jack section 12 is then rotated until the hook 30 of the latch 26 snaps below and is secured under the other side of the upper rim 70 of the base module 22. The jack section 12 may thereafter be removed by pressing the cantilevered arm 28 of the latch 26 toward the main body portion 18 of the jack section 12 so that the hook 30 becomes disengaged from the undersurface of the upper rim 70 of the base module 22. The jack section 12 may then be rotated to disengage the lip 24, and then removed.

The wire leads 44 are connected to the terminals 84 of the intermediate field 62 in a known manner using a special tool. In the preferred embodiment, the first pair 44*a* of wire leads 44 are connected to terminals 84 which are wired to the customer, and the second pair 44*b* of wire leads 44 are connected to terminals 84 which are wired to the telephone network central office. The wire leads 44 are connectable to any of the terminals 84 of the intermediate field 62, and are not limited to adjacent pairs of terminals 84.

Mounting of the base module 22 to the intermediate field 62 is accomplished by first inserting the web 80 of the base module 22 into any slot 82 along a side of the intermediate field 62 and such that the hook member 78 is beneath an underside of the side edge of the intermediate field 62. The base member 22 is then rotating onto the intermediate field 62 until the lug 76 becomes frictionally wedged between adjacent ones of the terminals 84 on the intermediate field 62 SO that the base module 22 is secure on the upper side of the intermediate field 62.

Alternatively, the base module 22 may simply be inserted directly onto the intermediate field 62 at any location as long as the lug 76 is wedged between adjacent terminals 84. Thus, the placement of the base module 22 is not limited by the particular location of the terminals 84 to which the wire leads 44 are connected.

Figure 8:
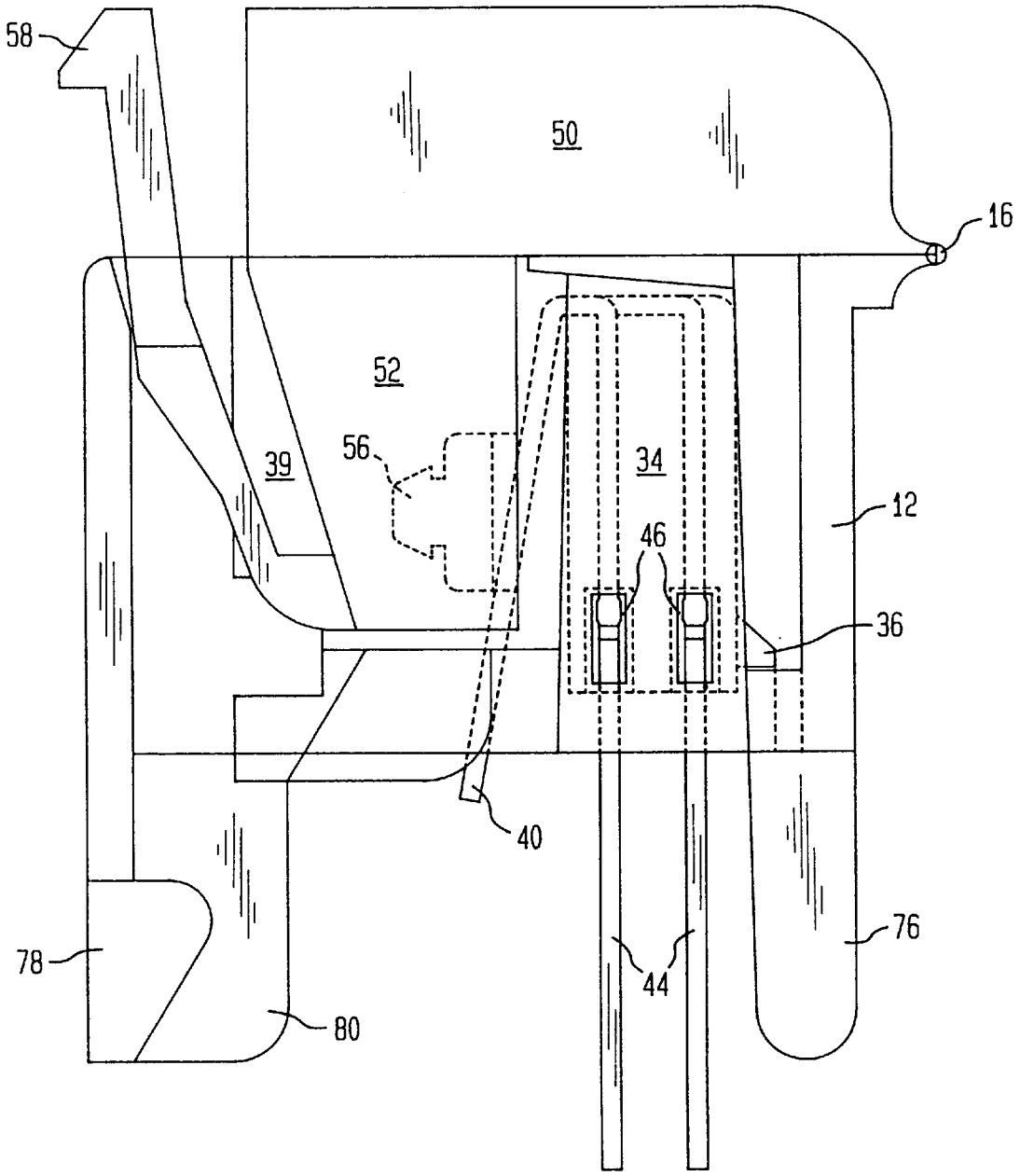
FIG. 8 is a side view of a network interface device according to a second embodiment in a closed position.
Figure 9:
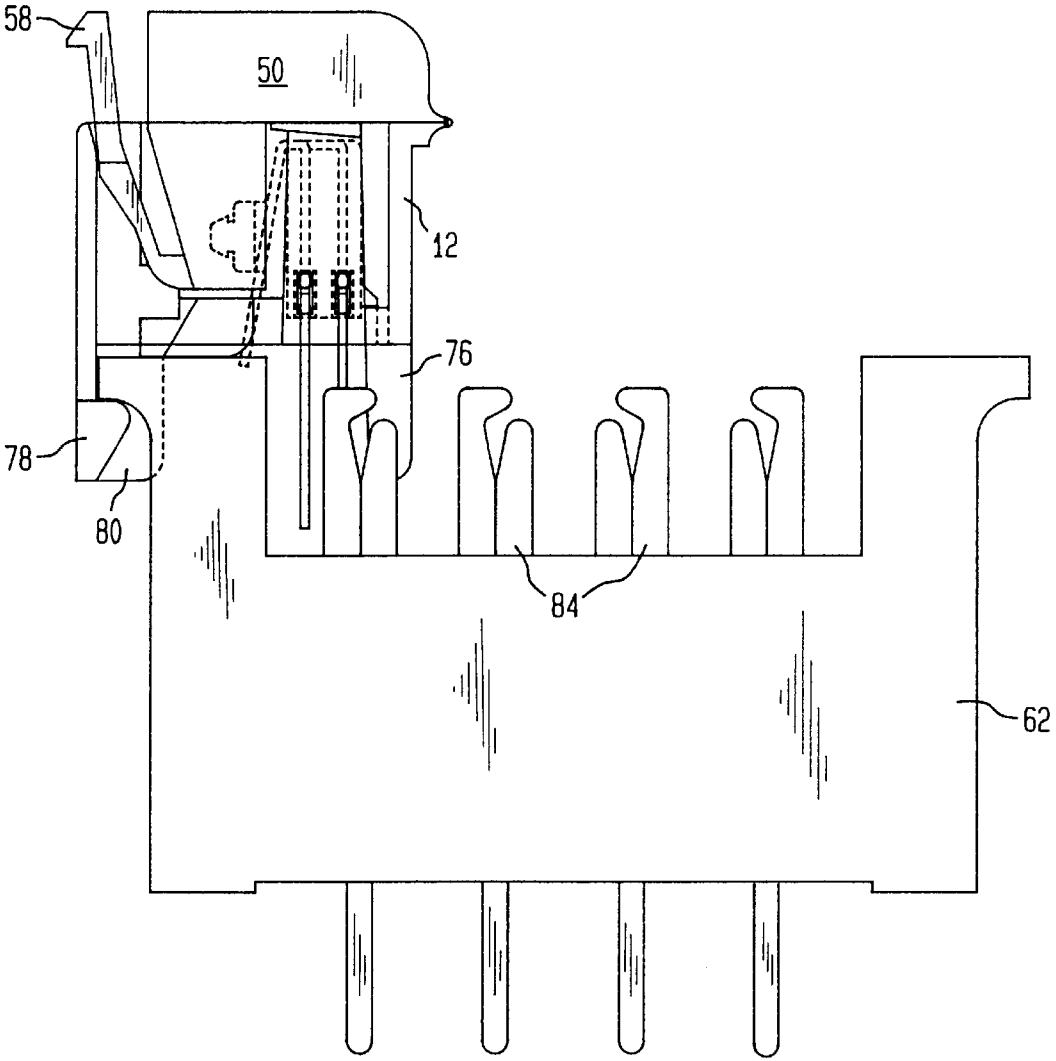
FIG. 9 is a side view of the network interface device of FIG. 8 in the closed position installed onto the terminals of an intermediate field.
Figure 10:
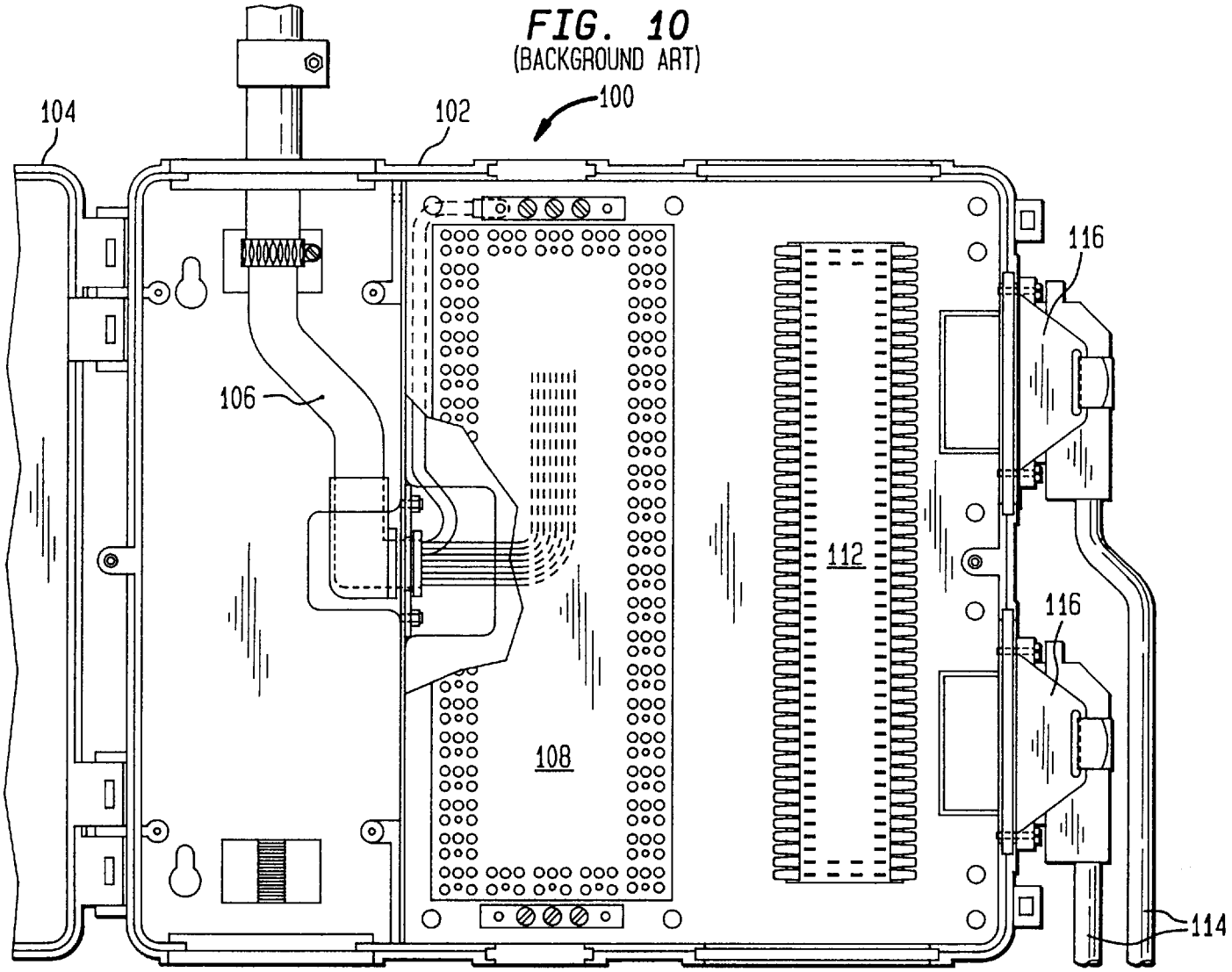
FIG. 10 (BACKGROUND ART)
FIG. 10 is a plan view of a building entrance protector of the background art.
Figure 11:
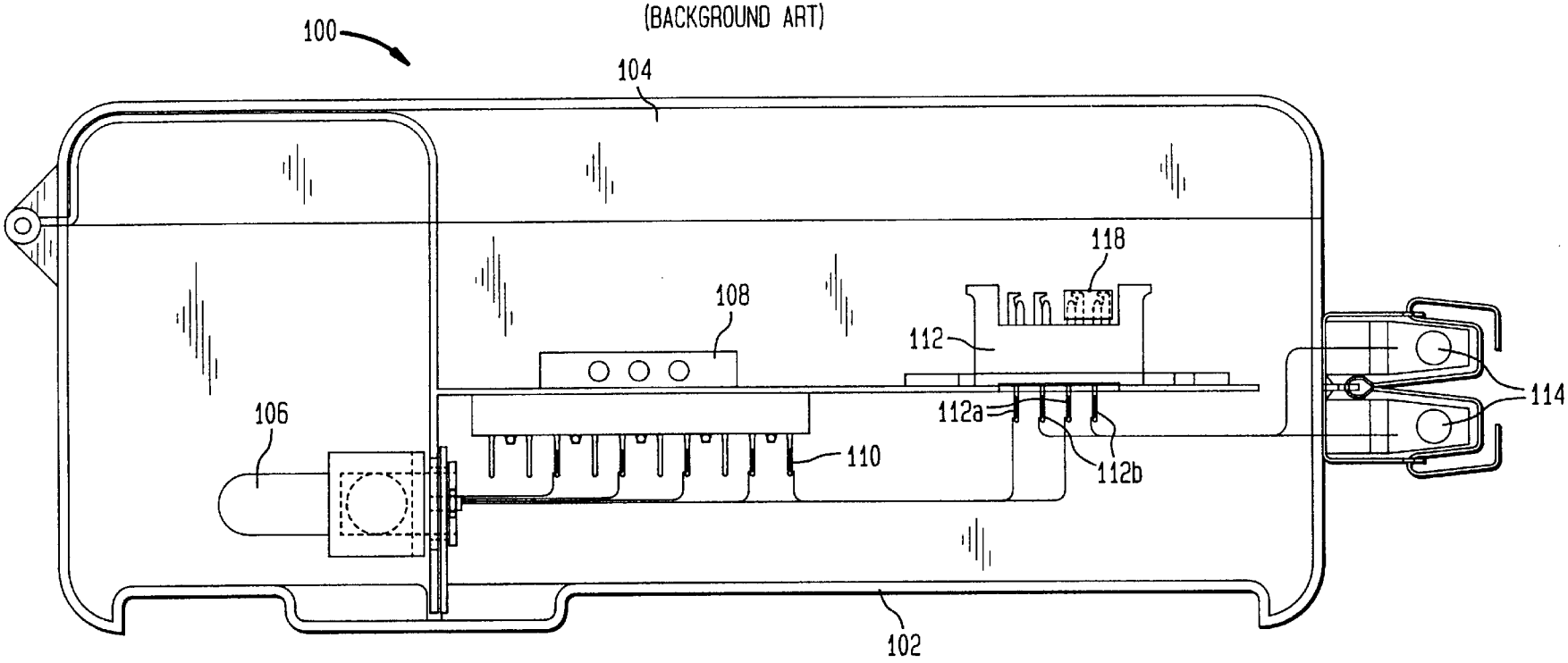
FIG. 11 (BACKGROUND ART)
FIG. 11 is an end view of the building entrance protector of the background art showing a bridging clip on the terminals of the intermediate field.
Figure 12:
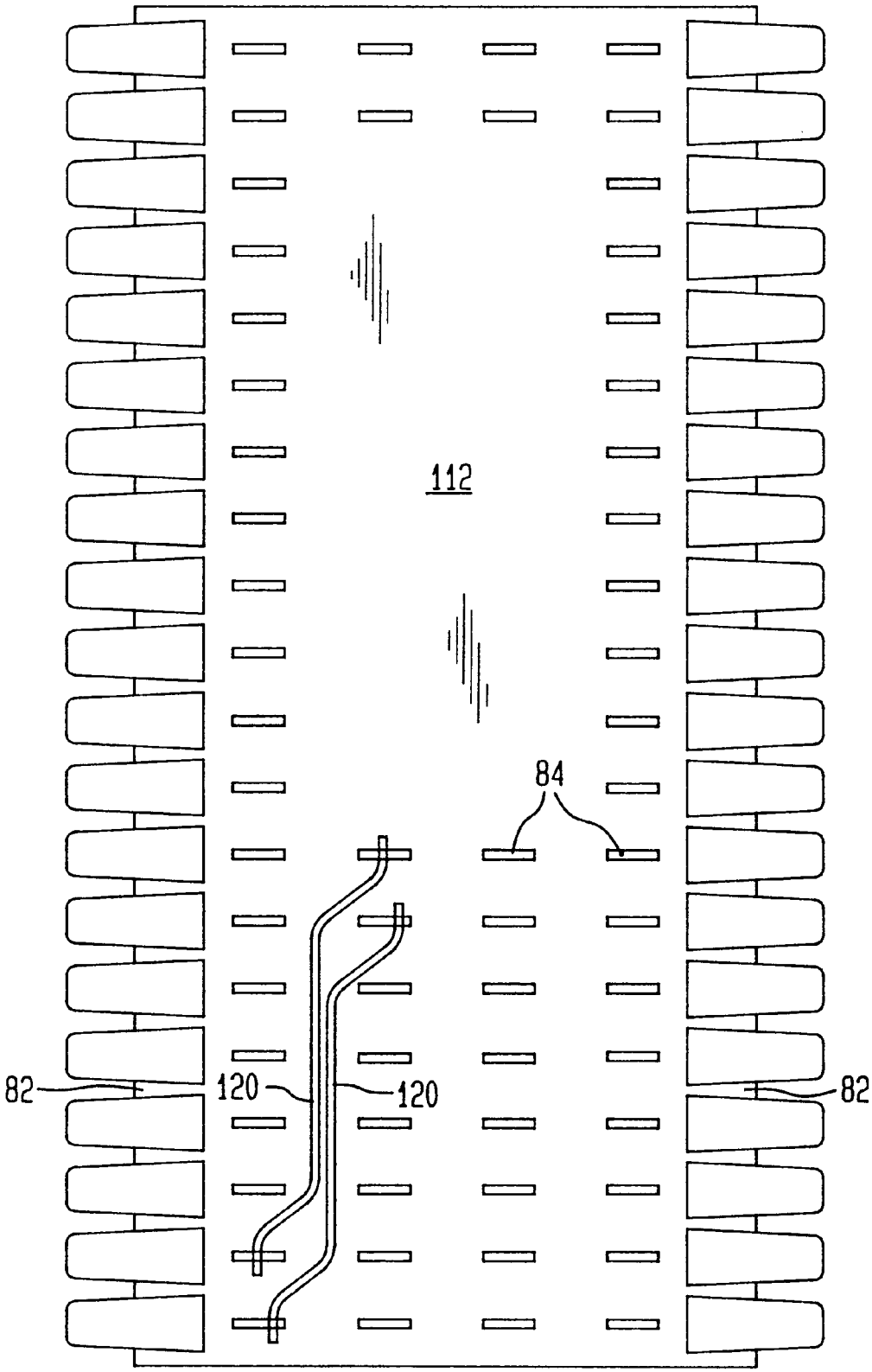
FIG. 12 (BACKGROUND ART)
FIG. 12 is a plan view of the intermediate field showing jumper wires for cross-connecting the central office to the customer.

FIG. 8 shows a second embodiment of the present invention wherein the network interface device and the base module are incorporated together as an integral unit. In the second embodiment of FIG. 8, the plug section 14 is the same, and the insert 34 is the same. However, the jack section 12 differs in that the lip 24 and the latch 26 have been eliminated. Further, the lug 76, hook member 78 and web 80 have been integrally formed on the rectangular base 20 of the jack section 12 such that the base module 22 and the jack section 12 are an integral one-piece unit. However, the web 80 does not extend from the lug 76 to the hook member 78 as in the first embodiment, although it is envisioned that such an arrangement is also possible with this second embodiment. Installation of the network interface device of FIG. 8 onto the intermediate field 62 is performed in the same manner as the installation of the base module 22 onto the intermediate field 62 set forth above with respect to the first embodiment.

The network interface device 10 of the present invention may be utilized on any of the terminals 84 on the intermediate field 62. However, it is desirable not to utilize this network interface device 10 on terminals 84 which are attached to special telephone lines, such as payphones and alarms, in order to avoid a situation where the alarm circuit is inadvertently disconnected. Instead, it is desirable to cover the terminals 84 of these devices with special caps (not shown) to prevent them from being disconnected and to prevent a network interface device 10 from being inadvertently connected onto them.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A connector comprising:

a jack section including a jack having a plurality of electrically conductive spring wires extending therein including a first spring wire and a second spring wire;

a plug section including a plug insertable into said jack, said plug having at least one conductive blade therein, said plug being insertable into said jack such that said at least one conductive blade electrically connects said first spring wire to said second spring wire; and a base module connected to said jack section, said base module having a lug insertable between adjacent terminals on an intermediate field to thereby retain the connector on the intermediate field.

2. The connector according to claim 1, further comprising a hinge pivotally connecting said plug section to said jack section such that said plug section may be moved from a closed position where said plug is located within said jack, to an open position where said plug is located outside of said jack.

3. The connector according to claim 1, wherein said jack section further comprises an insert located at least partially within said jack section, said insert including said plurality of spring wires extending therefrom and into said jack.

4. The connector according to claim 1, wherein said plurality of spring wires comprises a first pair of inner spring wires and a second pair of outer spring wires, said first spring wire comprising one of said pair of inner spring wires, and said second spring wire comprising one of said pair of outer spring wires.

5. The connector according to claim 4, further comprising a pair of said conductive blades, a first of said pair of conductive blades being engagable with said first spring wire and said second spring wire, and a second of said pair of conductive blades being engagable with another of said first pair of inner spring wires and another of said second pair of outer spring wires.

6. The connector according to claim 1, wherein said base module includes an aperture therein for receiving a lower portion of said jack section therein, said jack section includes a lip extending laterally away from one side of said jack section, and a latch located on an opposite side of said jack section, said lip and said latch retaining the jack section within said aperture of said base module.

7. The connector according to claim 1, wherein said base module further comprises a hook member and a web, said web being insertable into a slot located along a side of the intermediate field, with said hook member being positioned below a side lip of the intermediate field.

8. The connector according to claim 1, wherein said base module and said jack section are an integral one-piece unit.

9. The connector according to claim 8, wherein said base module comprises a lug extending downwardly from a bottom portion thereof, said lug being wedgable between adjacent terminals of the intermediate field to thereby frictionally retain said base module on the intermediate field.

10. A network interface device attachable to an intermediate field of a telephone network, said network interface device comprising:

a jack section including a jack having a first electrically conductive spring wire and a second electrically conductive spring wire extending therein, said first spring wire and said second spring wire being electrically isolated from one another;

a plug section including a plug insertable into said jack, said plug having at least one conductive blade therein, said plug being insertable into said jack such that said at least one conductive blade electrically connects the first spring wire to the second spring wire; and a hook member and a web for securing the jack section to the intermediate field, said web being insertable into a slot located along a side of the intermediate field, with said hook member being positioned below a side lip of the intermediate field.

11. The network interface device according to claim 10, further comprising an insert located within said jack section, said insert housing said first spring wire and said second spring wire.

12. The network interface device according to claim 10, wherein said first spring wire has a first wire lead attached thereto which is engagable with a first terminal on said intermediate field, and said second spring wire has a second wire lead attached thereto which is engagable with a second terminal on said intermediate field.

13. The network interface device according to claim 12, wherein said network interface device further comprises a third electrically conductive spring wire and a fourth electrically conductive spring wire, said third spring wire and said fourth spring wire being electrically isolated from one another and from said first and said second spring wires, said third spring wire having a third wire lead attached thereto which is engagable with a third terminal on said intermediate field, and said fourth spring wire having a fourth wire lead attached thereto which is engagable with a fourth terminal on said intermediate field.

14. The network interface device according to claim 10, further comprising a third electrically conductive spring wire and a fourth electrically conductive spring wire, said third spring wire and said fourth spring wire being electrically isolated from one another and from said first and said second spring wires, and further comprising a pair of said conductive blades, a first of said pair of conductive blades being engagable with said first spring wire and said second spring wire, and a second of said pair of conductive blades being engagable with said third spring wire and said fourth spring wire.

15. A network interface device attachable to an intermediate field of a telephone network, said network interface device comprising:

a jack section including a jack having a first electrically conductive spring wire and a second electrically conductive spring wire extending therein, said first spring wire and said second spring wire being electrically isolated from one another;

a plug section including a plug insertable into said jack, said plug having at least one conductive blade therein, said plug being insertable into said jack such that said at least one conductive blade electrically connects the first spring wire to the second spring wire; and a base module for securing the jack section to the intermediate field, said base module being connectable to the intermediate field, said base module having an aperture therein for receiving a lower portion of said jack section therein, wherein said jack section includes a lip extending laterally away from one side of said jack section, and a latch located on an opposite side of said jack section, said lip and said latch retaining the jack section within said aperture of said base module.

16. The network interface device according to claim 15, further comprising an insert located within said jack section, said insert housing said first spring wire and said second spring wire.

17. The network interface device according to claim 15, wherein said first spring wire has a first wire lead attached thereto which is engagable with a first terminal on said intermediate field, and said second spring wire has a second wire lead attached thereto which is engagable with a second terminal on said intermediate field.

18. The network interface device according to claim 17, wherein said network interface device further comprises a third electrically conductive spring wire and a fourth electrically conductive spring wire, said third spring wire and said fourth spring wire being electrically isolated from one another and from said first and said second spring wires, said third spring wire having a third wire lead attached thereto which is engagable with a third terminal on said intermediate field, and said fourth spring wire having a fourth wire lead attached thereto which is engagable with a fourth terminal on said intermediate field.

19. The network interface device according to claim 15, further comprising a third electrically conductive spring wire and a fourth electrically conductive spring wire, said third spring wire and said fourth spring wire being electrically isolated from one another and from said first and said second spring wires, and further comprising a pair of said conductive blades, a first of said pair of conductive blades being engagable with said first spring wire and said second spring wire, and a second of said pair of conductive blades being engagable with said third spring wire and said fourth spring wire.

20. A network interface device comprising:

an intermediate field having a plurality of terminals thereon;

a jack section including a jack having a first electrically conductive spring wire and a second electrically conductive spring wire extending therein, said first spring wire and said second spring wire being electrically isolated from one another;

a plug section including a plug insertable into said jack, said plug having at least one conductive blade therein, said plug being insertable into said jack such that said at least one conductive blade electrically connects the first spring wire to the second spring wire; and a base module for securing the jack section to the intermediate field, said base module being connectable to the intermediate field, wherein said base module includes a lug extending downwardly therefrom, said lug being wedgable between adjacent ones of said terminals of the intermediate field to thereby frictionally retain said base module on the intermediate field.

21. The network interface device according to claim 20, further comprising an insert located within said jack section, said insert housing said first spring wire and said second spring wire.

22. The network interface device according to claim 20, wherein said first spring wire has a first wire lead attached thereto which is engagable with a first terminal on said intermediate field, and said second spring wire has a second wire lead attached thereto which is engagable with a second terminal on said intermediate field.

23. The network interface device according to claim 22, wherein said network interface device further comprises a third electrically conductive spring wire and a fourth electrically conductive spring wire, said third spring wire and said fourth spring wire being electrically isolated from one another and from said first and said second spring wires, said third spring wire having a third wire lead attached thereto which is engagable with a third terminal on said intermediate field, and said fourth spring wire having a fourth wire lead attached thereto which is engagable with a fourth terminal on said intermediate field.

24. The network interface device according to claim 20, further comprising a third electrically conductive spring wire and a fourth electrically conductive spring wire, said third spring wire and said fourth spring wire being electrically isolated from one another and from said first and said second spring wires, and further comprising a pair of said conductive blades, a first of said pair of conductive blades being engagable with said first spring wire and said second spring wire, and a second of said pair of conductive blades being engagable with said third spring wire and said fourth spring wire.

* * * * *